United States Patent [19]

Lapins et al.

[11] Patent Number: 4,630,416

[45] Date of Patent: Dec. 23, 1986

[54] ACOUSTICAL PANEL

[75] Inventors: Daniel W. Lapins, Holland; Richard Szymanski, Norton Shores, both of Mich.

[73] Assignee: Haworth, Inc., Holland, Mich.

[21] Appl. No.: 732,482

[22] Filed: May 9, 1985

[51] Int. Cl.[4] ..... E04B 2/28

[52] U.S. Cl. ..... 52/239; 52/144; 52/145; 181/286; 181/287; 181/290

[58] Field of Search ..... 52/144, 145, 239; 181/286, 287, 290

[56] References Cited

U.S. PATENT DOCUMENTS

| | | | |
|---|---|---|---|
| 3,712,846 | 1/1973 | Daniels et al. | 181/290 X |
| 3,934,382 | 1/1976 | Gartung | 52/144 |
| 4,084,366 | 4/1978 | Saylor et al. . | |
| 4,084,367 | 4/1978 | Saylor et al. . | |
| 4,155,211 | 5/1979 | Saylor et al. . | |

FOREIGN PATENT DOCUMENTS

| | | | |
|---|---|---|---|
| 50450 | 4/1982 | European Pat. Off. | 52/144 |
| 3149752 | 6/1983 | Fed. Rep. of Germany | 52/145 |
| 2311146 | 12/1976 | France | 52/145 |

*Primary Examiner*—Alfred C. Perham

*Attorney, Agent, or Firm*—Flynn,Thiel,Boutell & Tanis

[57] ABSTRACT

A movable, prefabricated wall panel having a rigid rectangular frame. A core structure is disposed in the region bounded by the frame, which core structure preferably comprises at least one honeycomb layer. Sheetlike skins are fixedly secured to opposite sides of the frame and extends across the region bounded by the frame for confining the honeycomb layer therebetween. A plurality of small openings are formed in either or both of the skins so that they communicate with cells of the honeycomb layer to create Helmholtz sound-absorbing chambers. Each sheetlike skin is covered by a layer of porous fiberglass material for absorbing sound, which layer includes an inner thin mat of high-density fiberglass which is in turn covered by a relatively thick outer layer of low-density fiberglass. This outer layer has a variable density gradient across the thickness thereof, which density gradient progressively increases across the thickness toward the mat.

12 Claims, 3 Drawing Figures

ACOUSTICAL PANEL

FIELD OF THE INVENTION

This invention relates to a wall or space-divider structure formed by a plurality of prefabricated panels and, in particular, to an improved acoustical panel which possesses a high noise reduction coefficient while additionally possessing sufficient strength to permit fixtures and accessories to be hung thereon.

BACKGROUND OF THE INVENTION

Wall structures formed from a plurality of interconnected, prefabricated, portable panels are used extensively in commercial and industrial buildings for dividing interior regions into smaller work regions. Such structures have proven particularly effective in providing greater privacy within the building, and at the same time improving the interior appearance. For this purpose, the panels are provided with many different exterior finishes, such as colored plastics, carpets and fabrics. Some of these panels also tend to minimize noise, particularly when they are provided with soft exterior finishes, such as by being covered by carpeting or fabric. Many panels of this type are also provided with slotted rails extending vertically along the edges thereof, whereby fixtures such as desks, shelves, filing cabinets and the like can be mounted on the panels. Due to the desire to mount these fixtures on the panels, the panels must thus be provided with substantial strength and, accordingly, are normally provided with a relatively strong and rigid core so as to provide the necessary strength.

While panels of the above type tend to minimize noise, nevertheless any noise absorption capability of the panel is normally provided solely by the outer coverings. Further, since these panels are normally of a height substantially less than the floor-to-ceiling height, this also permits the transmission of substantial noise over the panel which, when coupled with the inability of the panels to absorb a high percentage of sound at various frequencies, thus results in these panels being unacceptable for use in situations where a high noise reduction and absorption by the panel is necessary. Because of this inability to absorb a high percentage of the sound in the environment, these panels have conventionally been referred to as a nonacoustical-type panels.

In recognition of this problem, U.S. Pat. Nos. 4,084,366, 4,084,367 and 4,155,211, which are owned by the assignee of this invention, disclose acoustical panels which represent a substantial improvement over prior structures in terms of their ability to absorb a high percentage of various frequency sound waves while at the same time being both aesthetically pleasing in appearance and structurally strong so as to permit accessories and fixtures to be hung thereon. In the panels disclosed in the above-mentioned patents, the core of the panel is provided with a honeycomb structure which is covered by perforated side skins to form a plurality of Helmholtz resonators for effectively absorbing sound waves, particularly those sound waves of lower frequency. The side skins in turn are covered by layers of porous sound-absorbing material, such as fiberglass, to effectively absorb those sound waves of higher frequency, whereby the resultant panel possesses a capability of absorbing a significant percentage of sound wave frequencies typically encountered within an office-type working environment.

While the panels disclose in the above-mentioned patents have proven desirable for use in an office-type environment, and have also been effective for absorbing at least a significant part of sound waves of selected frequencies, nevertheless substantial additional research and development has been carried out on acoustical panels of this type in an attempt to further improve upon the sound-absorbing characteristics thereof so as to provide the panel with a high and consistently reproducible noise-reduction coefficient (NRC). More specifically, this additional research and development has been carried out with respect to improving the sound-absorbing capability of the fiberglass layer such that this latter layer will be more effective for absorbing a greater percentage of the existing sound waves and a greater percentage of different frequency sound waves as typically encountered in the office environment. At the same time, it has been essential that this development with respect to the fiberglass layer still result in the side of the panel having a soft touch or feel as provided by the fiberglass layer and the external fabric covering thereover, with such soft layer being such as to provide a very pleasing appearance when covered.

Accordingly, it is an object of the present invention to provide an improved acoustical panel for absorbing a large degree of directed sound of various frequencies, which panel possesses a high noise reduction coefficient and also possesses substantial strength to enable fixtures to be hung thereon.

More specifically it is an object of this invention to provide an improved acoustical panel, as aforesaid, which possesses an improved fiberglass sound-absorbing layer which is of variable density so as to provide highly improved sound-absorbing capability over a significant range of frequencies, while at the same time providing an extremely soft top surface so as to enhance or maintain the desirable aesthetic and touch properties deemed essential for the panel sidewalls.

In the improved acoustical panel as aforesaid, a variable-density fiberglass layer is preferably provided with a very low density on the outer or top surface thereof, which low density extends over a significant depth so as to provide the desired soft surface, with the remaining thickness of the fiberglass layer being of significantly increasing density so that the fiberglass layer, over a majority of the thickness thereof, has a density variation in the range of at least about 3 to 1 as measured between the outer and inner surfaces The rear or inner surface of the fiberglass layer has bonded thereto a thin extremely high-density mat of fiberglass material having a density which is a large multiple (such as ten times) that of the soft outer surface This high density mat in turn overlies the skin of the panel, whereby the overall acoustical panel provides a highly improved capability of absorbing substantial quantities of sound waves of significantly different frequencies, and thereby provides the panel with a desirably high noise reduction coefficient.

Other objects and purposes of the invention will be apparent to persons familiar with panels of this general type upon reading the following specification and inspecting the accompanying drawings.

Figure 1:
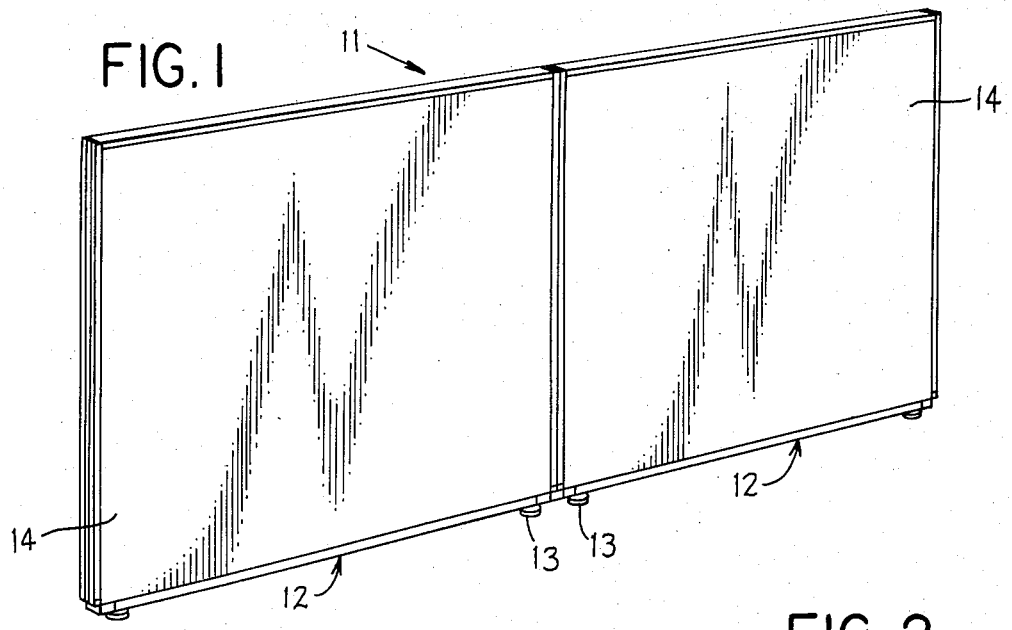
FIG. 1 is a perspective view of a wall or partition system formed from two prefabricated movable panels.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the panel and designated parts thereof. Said terminology will include the words specifically mentioned, derivatives thereof and words of similar import.

DETAILED DESCRIPTION

FIG. 1 illustrates a wall system 11 formed by a pair of substantially identical, prefabricated, acoustical-type portable panels or partitions 12. The panels are supported in an upright position on a support surface, such as a floor, by adjustable feet 13. The panels have opposed planar side surfaces 14. While two panels have been illustrated, it will be appreciated that any desired number of panels can be connected together in aligned or angled relationship.

The panel 12 is of substantially rectangular shape and is defined by horizontally extending top and bottom edges joined by opposed vertically extending side edges. This rectangular shape is defined by a rigid rectangular frame 16 disposed internally of the panel and formed from a plurality of substantially channel-shaped rails. One channel-shaped rail 17 extends along the top of the panel, and additional channel-shaped rails 18 extend vertically along the side edges of the panel.

Figure 2:
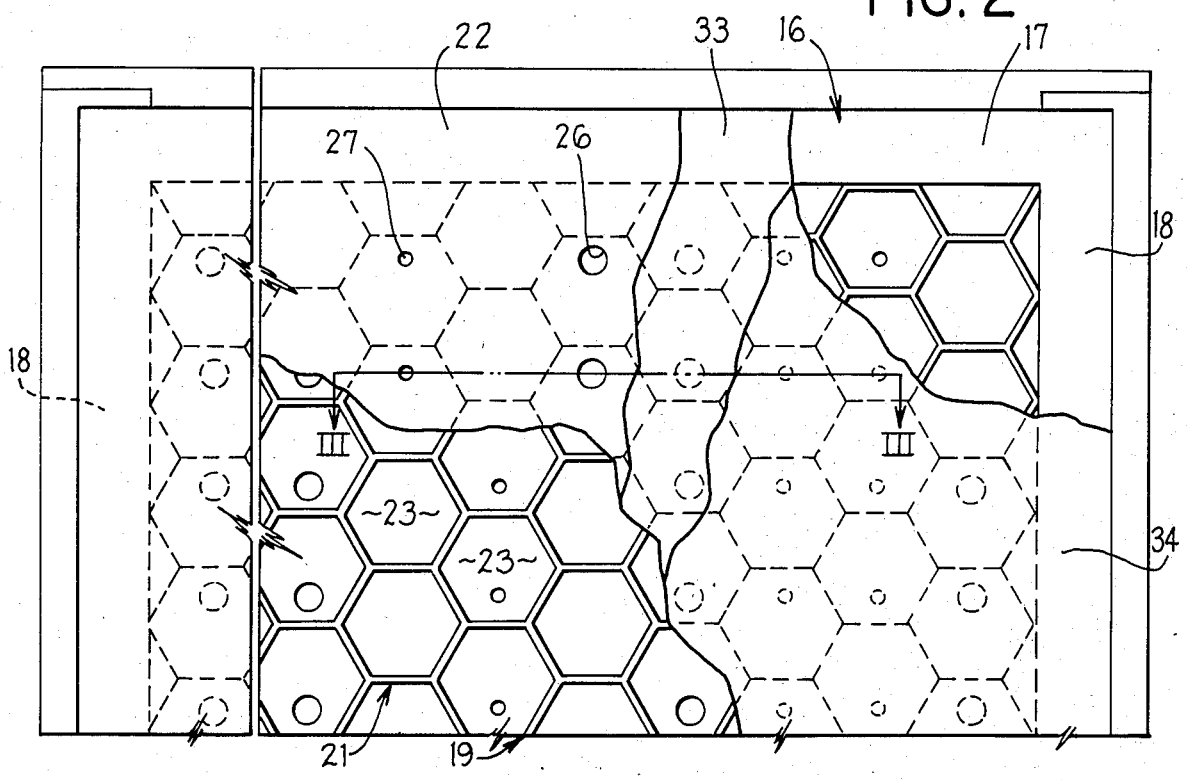
FIG. 2 is a fragmental side elevational view of an acoustical panel according to the present invention and showing a part of one side skin and overlying fiberglass layer partially removed for purposes of illustration.
Figure 3:
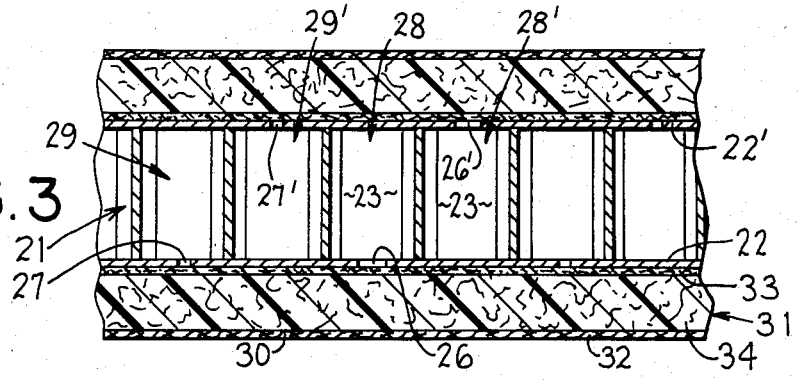
FIG. 3 is a fragmentary sectional view taken substantially along line III—III in FIG. 2.

The frame 16 supports a sound-absorbing core structure 19 which, as shown in FIGS. 2 and 3, includes a honeycomb layer 21 disposed within the rectangular frame, which honeycomb layer in turn has the opposite faces thereof secured to a pair of thin facing sheets or skins 22 and 22' disposed on opposite sides of the panel. These skins 22 and 22' are fixedly secured to the opposite sides of the honeycomb layer and are also fixedly secured to the opposite sides of the frame 16, as by an adhesive. The facing skins are normally of a thin sheet metal and confine the honeycomb layer or core 21 therebetween.

In the panel 12, the honeycomb layer 21 is substantially of a single cell size, such as cell 23, which cell extends across the full width of the panel between the opposite skins 22 and 22'. To permit these cells 23 to function as sound-absorbing resonators of the type commonly known as Helmholtz resonators, the skin 22 is provided with small circular openings or apertures 26 and 27 extending therethrough, which openings are disposed for communication with selected cells 23 to define Helmholtz resonators.

The openings 26 are of a first larger diameter, with the individual openings 26 being disposed substantially within a vertically extending row so that each opening 26 communicates with an underlying cell 23 to define a Helmholtz resonator 28 capable of absorbing sound waves of a first frequency. In similar fashion, the holes 27 are of a second diameter which is smaller than the diameter of the holes 26. These holes 27 are also disposed in a substantially vertically aligned row, with each hole 27 being disposed for communication with a single underlying cell 23 to define a Helmholtz resonator 29 capable of absorbing a sound wave frequency which is different from that absorbed by the resonator 28. In this fashion, two different types of resonators are formed capable of absorbing sound waves of significantly different frequencies.

The skin 22' is identical to the skin 22, and in fact is merely rotated 180° relative to the skin 22 so that the openings 26' and 27' as formed in the skin 22' will align with individual cells 23 and hence create additional resonators 28' and 29' which open outwardly through the other side of the panel.

The openings 26 and 27 as formed in the skin 22 are horizontally alternately spaced and are separated so as to effectively align with alternate vertical rows of cells 23, whereby alternate cells communicate with openings 26 or 27 to define resonators which open outwardly through one side of the panel. The remaining alternate rows of cells 23 align with the other openings 26' and 27' so as to define resonators which open outwardly through the opposite side of the wall panel.

The honeycomb layer 21 and the overlying skins 22,22' effectively define a septum or membrane which extends across the frame so as to prevent direct sound transmission through the panel.

This structure of the sound-absorbing core 19, as formed by the honeycomb layer 21 and the enclosing perforated skins 22 and 22', is described in greater detail in aforementioned U.S. Pat. No. 4,155,211.

To improve the sound-absorbing efficiency, both in terms of the quantity and frequency range of sound waves absorbed, the panel is also provided with a layer of porous sound-absorbing material 31 disposed so as to overlie each of the skins 22 and 22'. This porous sound-absorbing layer 31 in turn is suitably covered by an exterior decorative covering 32, such as a fabric covering.

According to the present invention, this porous sound-absorbing layer 31 is a laminated variable-density fiberglass layer which possesses the capability of absorbing substantial quantities of sound waves of different frequencies. For this purpose, the laminated layer 31 includes a very thin but high-density inner strata 33 which directly overlies the outer surface of the adjacent skin, with this inner strata 33 being coextensive with a thick, significantly lower-density outer strata 34.

As to this outer strata 34, it is preferably of substantial thickness, such as about 0.8 inch ± about 10%. The density of this outer strata 34 is variable and increases as the thickness of the strata extends from its outer or face surface to its inner surface. For example, this strata 34 through approximately two-thirds of its total thickness as measured from the top or outer surface has a nominal density of about 1.0 pounds per cubic foot and contains a minimum of binder. The nominal average density of this strata 34 when considered over its complete thickness, however, is about 1.2 pounds per cubic foot.

Since the fiberglass strata 34 is of a variable-density gradient with the lighter density being on the outer or face surface and the heavier density being disposed immediately adjacent the inner strata 33, the fiberglass strata 34 may for explanatory purposes be considered as divided into four sublayers of equal thickness. The first two sublayers closest to the outer surface have a binder density ratio, relative to the arithmetic total for all four sublayers, of approximately 1:7 for each of the top two sublayers. The third sublayer will average a binder density ratio, to the arithmetic total, of approximately 2:7. The fourth sublayer (i.e., the sublayer directly adjacent the inner strata 33) will average a binder density ratio, to the arithmetic total, of approximately 3:7. The variable-density gradient across the thickness of the strata 34 results in the density of the innermost sublayer being several times (such as approximately three times) greater than the density of the sublayer which defines the outer surface.

As to the inner strata or layer 33, this is conventionally formed by a thin high-density fiberglass mat of the type commonly known as a Schuller mat. The mat defining this inner layer 33 preferably has a thickness of about 0.036 inch, although this thickness could be as little as about 0.026 inch. The thickness could, however, significantly increase from the preferred 0.036 inch thickness since significant increases in this thickness, such as up to about 0.070 to 0.080 inch, will still provide the panel with highly desirable sound-absorbing characteristics. This Schuller mat 33 is of a high-density fiberglass such that the mat has a density of approximately 10 pounds per cubic foot, ± about 15%, although the density of this mat may go as low as about 6 to 7 pounds per cubic feet.

In the preferred embodiment of the fiberglass layer 31, the thick but variable low-density outer layer 34 is integrally bonded to the thin high-density inner layer 33. This heavier layer 33 in turn is disposed directly adjacent and overlies the exterior surface of the respective skin 22 or 22'. The layer 31 is held in overlying relationship to the skin 22,22' by means of the external fabric covering 30, the latter having its edges secured to the panel frame in a conventional manner.

It has been experimentally observed that the presence of this sound-absorbing layer 31, in conjunction with the acoustical sound-absorbing core 19, significantly improves the sound-absorbing characteristics of the panel such that the overall noise-reduction coefficient (NRC) is significantly improved. While the exact reasons for such improvement are not known, nevertheless it is believed that at least in part the presence of the thin high-density layer 33 and its superposition directly over the skin 22 or 22' causes the axial length of the openings 26 and 27 to effectively act as if they had been axially extended due to the presence of the overlying mat 33.

The fiberglass sound-absorbing layer 31 according to the present invention, particularly when used in conjunction with a wall panel employing the sound-absorbing core 19, has been observed to provide significantly improved acoustical properties, namely the capability of absorbing significant sound waves of different frequencies, while at the same time the panel retains a desirable soft touch or feel on the side surfaces thereof. Further, the softness of the outer strata of the fiberglass layer is particularly desirable for permitting the outer covering fabric 32 to be stretched thereover so as to also provide the panel with a desirable exterior appearance.

While this improved fiberglass layer 33 has been disclosed for use with a panel having a sound-absorbing core 19 employing Helmholtz resonators, nevertheless it is believed that this fiberglass layer 31 would also be highly desirable for use with a space-divider panel which does not employ the sound-absorbing core 19. For example, fiberglass layers 31 could be mounted directly over the opposite sides of a skin or membrane equivalent to the skin 22 or 22', which skin or membrane (such as an aluminum membrane) would be free of perforations and could provide structural strengthening for the panel and support for the fiberglass layers if necessary.

While the panel as described above employs a conventional honeycomb layer which is preferably of paper and of uniform cell size, it will be appreciated that the honeycomb layer could employ cells of different size, and could also employ back-to-back cells separated by an intermediate membrane, if desired. The number and size variations of the holes in the skins, and the pattern of the holes, could also be suitably varied as desired.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an interior space dividing wall formed from a plurality of portable interior upright space-divider panels which are horizontally connected together in series, said panel having opposed enlarged side surfaces and a sound-absorbing core structure disposed between said side surfaces and extending substantially coextnesively over the area thereof, said core structure including first means for absorbing sound waves of one frequency and second means for absorbing sound waves of a substantially different frequency, said first means including a plurality of Helmholtz resonators each defined by a small substantially closed chamber disposed interiorly of the wall panel and communicating with the surrounding environment through small opening means which project outwardly from the respective chamber toward one of the side surfaces of the panel, said first means including a thin sheetlike skin having said small opening means extending therethrough, and said second means including a layer of porous-sound-absorbing material overlying said plurality of Helmholtz resonators, said layer being of a porous fiberglass material, the improvement wherein said layer comprises:

a thin inner layerlike strata disposed so as to directly overlie said pluraltiy of Helmholtz resonators and said thin skin, said inner strata being of a high-density fiberglass material, and a thick outer layerlike strata disposed directly adjacent and coextensively overlying said inner strata, said outer strata being of a low-density fiberglass material, said outer strata having a density gradient which increases as it extends from its outer surface toward said inner strata, said outer strata consisting of a single integral layer having a variable density which progressively increases across the thickness thereof toward said inner strata, said outer strata having a thickness which is several times greater than the thickness of said inner strata, said inner strata having a density which is several times greater than the average density of said outer strata and which is also greater than the maximum density of said outer strata, and said inner strata having a maximum thickness of about 0.080 inch and a minimum density of about 6 pounds per cubic foot.

2. A wall system according to claim 1, wherein said plurality of Helmholtz resonators is defined by an interior honeycomb core structure which defines therein a plurality of cells and a pair of said thin sheetlike skins bonded to the opposite sides of said honeycomb core structure for closing off the ends of said cells, said skins having small openings therethrough for communication with selected cells for defining said Helmholtz resonators, and a said porous sound-absorbing layer being positioned exteriorly over each of said skins so that the inner strata of each layer directly overlies the respective skin.

3. A wall system according to claim 1, wherein the inner strata has a density of about ten pounds per cubic foot.

4. A wall system according to claim 3, wherein said outer strata has a density gradient which varies from a minimum of about 1.0 to a maximum of about 3.0 pounds per cubic foot across the thickness of the outer strata.

5. A wall system according to claim 4, wherein said outer strata has a thickness of at least about eight times the thickness of the inner strata.

6. A wall system according to claim 1, wherein said inner strata has a thickness of at least about 0.030 inch but no greater than about 0.080 inch, and wherein said outer strata has a thickness in the range of about 0.700 to about 0.900 inch.

7. A wall system according to claim 6, wherein said inner strata has a density of about ten pounds per cubic foot, and wherein said outer strata has an average density of about 1.0 to about 1.5 pounds per cubic foot.

8. In an upright space-divider panel of the acoustical type, said panel having a substantially rectangular frame and a sound-absorbing core structure positioned within said frame, said core structure including a septum structure extending across said frame and a pair of sound-absorbing layers supported on and extending coextensively across the opposite side faces of said septum structure, each said layer being of porous sound-absorbing material, and a thin fabric covering extending coextensively over the outer surface of said sound-absorbing layer, the improvement wherein said layer of porous sound-absorbing material comprises an outer relatively thick layer of low-density fiberglass coextensively extending over an inner relatively thin layer of high-density fiberglass, said inner layer being formed substantially as a thin mat having a thickness in the range of about 0.030 to about 0.080 inches and density of at least about 6 pounds per cubic foot, and said outer layer having a thickness which is several times the thickness of said inner layer and a density which is a small fraction of the density of the inner layer, said outer layer being a single integral layer having a variable density which progressively increases across the thickness thereof in a direction from the outer surface toward said inner layer.

9. A wall panel according to claim 8, wherein said outer layer has a thickness in the range of about 0.700 inch to about 0.900 inch and an average density in the range of about 1.0 to about 1.5 pounds per cubic foot.

10. A wall panel according to claim 9, wherein said septum structure includes a sheetlike structural skin fixed to and extending across said frame, said sound-absorbing layer being supported on and coextensively extending across said sheetlike skin with said inner layer being superimposed directly over said skin.

11. A wall panel according to claim 8, wherein said outer layer is integrally bonded to said inner layer.

12. A wall panel according to claim 8, wherein said single integral layer across the thickness thereof can for explanatory purposes be considered as divided into four sublayers of equal thickness, the first two sublayers closest to the outer surface having a binder density ratio relative to the arithmatic total of all four sublayers of approximately 1:7 for each of the top two sublayers, the third sublayer having a binder density ratio relative to the arithmatic total of approximately 2:7, and the fourth sublayer as disposed directly adjacent the said inner layer having a binder density ratio relative to the arithmatic total of approximately 3:7.

* * * * *